US005765753A

United States Patent [19]

Kieffer

[11] Patent Number: 5,765,753

[45] Date of Patent: Jun. 16, 1998

[54] REVERSIBLE SPRAY TIP

[75] Inventor: Joseph W. Kieffer, Rogers, Minn.

[73] Assignee: Wagner Spray Tech Corporation, Minneapolis, Minn.

[21] Appl. No.: 683,300

[22] Filed: Jul. 18, 1996

[51] Int. Cl.[6] ..... B05B 15/02

[52] U.S. Cl. ..... 239/119; 239/600

[58] Field of Search ..... 239/104, 106, 239/119, 600

[56] References Cited

U.S. PATENT DOCUMENTS

| | | | |
|---|---|---|---|
| 2,564,431 | 8/1951 | Greenspoon | 299/107 |
| 3,116,882 | 1/1964 | Vork | 239/587 |
| 3,202,360 | 8/1965 | O'Brien | 239/119 |
| 3,460,757 | 8/1969 | Adams | 239/119 |
| 3,593,920 | 7/1971 | Watson | 239/119 |
| 3,645,450 | 2/1972 | Calder | 239/116 |
| 3,667,681 | 6/1972 | Blancha | 239/393 |
| 3,752,400 | 8/1973 | Calder | 239/116 |
| 3,831,862 | 8/1974 | Calder | 239/526 |
| 3,955,763 | 5/1976 | Pyle et al. | 239/119 |
| 4,074,857 | 2/1978 | Calder | 239/119 |
| 4,108,379 | 8/1978 | Talley | 239/119 |
| 4,116,386 | 9/1978 | Calder | 239/119 |
| 4,157,163 | 6/1979 | Pinto et al. | 239/119 |
| 4,165,836 | 8/1979 | Eull | 239/119 |
| 4,437,610 | 3/1984 | Huber et al. | 239/119 |
| 4,465,236 | 8/1984 | Calder | 239/391 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,513,913 | 4/1985 | Smith | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,629,121 | 12/1986 | Hengesbach | 239/119 |
| 4,635,850 | 1/1987 | Leisi | 239/119 |
| 4,682,731 | 7/1987 | Bolton | 239/119 |
| 4,715,537 | 12/1987 | Calder | 239/119 |
| 4,736,892 | 4/1988 | Calder | 239/592 |
| 4,757,947 | 7/1988 | Calder | 239/119 |
| 4,819,872 | 4/1989 | Rosenberg | 239/119 |
| 4,830,281 | 5/1989 | Calder | 239/119 |
| 4,971,249 | 11/1990 | Tam et al. | 239/119 |
| 5,094,402 | 3/1992 | Perret, Jr. et al. | 239/526 |
| 5,255,848 | 10/1993 | Rhodehouse | 239/119 |
| 5,280,853 | 1/1994 | Perret, Jr. | 239/119 |
| 5,294,053 | 3/1994 | Perret, Jr. | 239/119 |
| 5,340,029 | 8/1994 | Adams | 239/119 |
| 5,379,938 | 1/1995 | Peret, Jr. | 239/119 |
| 5,379,939 | 1/1995 | Perret, Jr. | 239/119 |
| 5,454,515 | 10/1995 | Perret | 239/119 |
| 5,505,381 | 4/1996 | Torntore | 239/119 |

*Primary Examiner*—Andres Kashnikow
*Assistant Examiner*—Lisa Ann Douglas
*Attorney, Agent, or Firm*—Faegre & Benson

[57] ABSTRACT

A reversible spray tip assembly with a replaceable tip member keyed to orient an orifice therein to a turret of the assembly and carrying a replaceable member having visually perceptible indicia to identify the size and fan width of the orifice of the tip member installed in the turret assembly. The replaceable member may be in the form of a plug, clip, band, sticker, or tablet insertable into the handle of the turret, or the handle itself may be user-replaceable. Alternatively, thumbwheels may be provided in the handle to display the tip identification indicia.

8 Claims, 7 Drawing Sheets

REVERSIBLE SPRAY TIP

BACKGROUND OF THE INVENTION

This invention relates to the field of portable paint spraying equipment, more particularly to a high pressure, airless spray tip assembly with a reversible turret for clearing a clogged orifice.

DETAILED DESCRIPTION OF THE INVENTION

Figure 1:
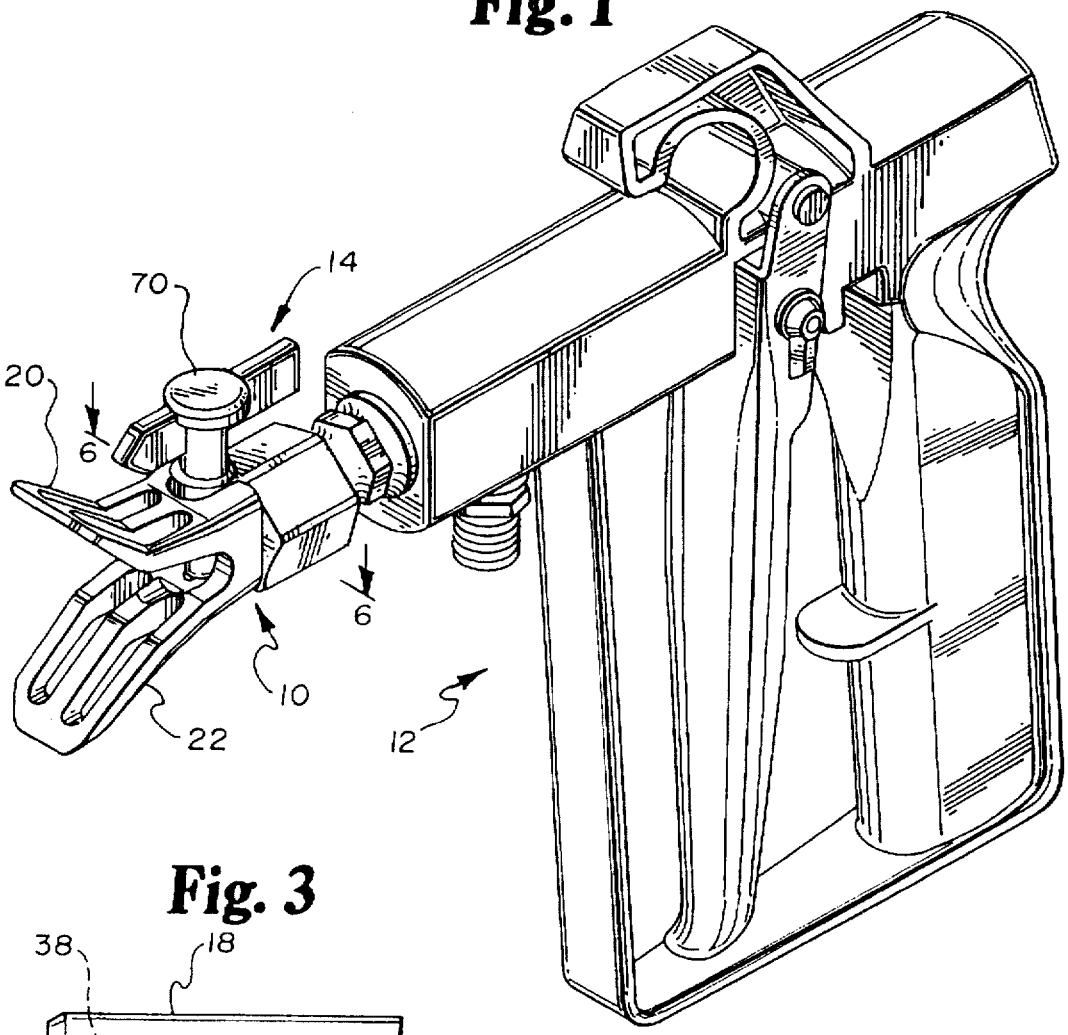
FIG. 1 is a perspective view of a spray gun carrying the reversible tip assembly of the present invention.

Referring to the Figures and most particularly to FIG. 1, a replaceable tip assembly 10 useful in the practice of the present invention may be seen. Replaceable tip assembly 10 is shown attached to an airless spray gun 12 useful for spraying paints and other similar coating materials under relatively high pressure. In such spraying applications, it has been found useful to provide a reversible mounting for the spray orifice to clear blockages. In the past, such mountings were provided by a turret assembly which had a tip with a desired orifice permanently installed in the turret. Once the orifice was worn to an unacceptable extent, the entire turret was required to be replaced. Such turrets did, however often have the advantage of being marked with an indication of the orifice size to aid the operator in selecting the proper orifice for the work at hand.

Figure 2:
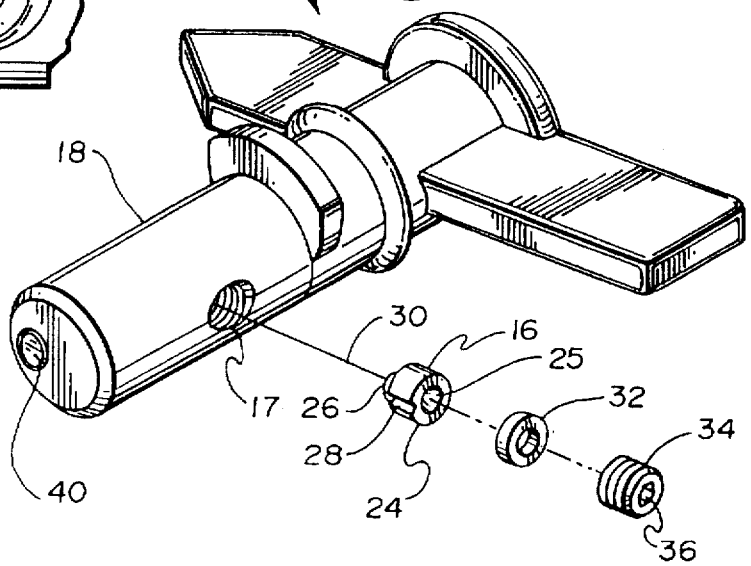
FIG. 2 is a view of a turret and user-replaceable parts exploded useful in the practice of the present invention.

Referring now most particularly to FIG. 2, the present invention overcomes the disadvantage of requiring replacement of the entire turret when the tip orifice is worn by providing a turret assembly 14 which has a spray tip 16 which may be replaced by an operator. Spray tip 16 is received in a threaded bore 17 of a barrel 18 of the turret assembly 14. Spray tip 16 is preferably formed of carbide and has a "cat's eye" orifice therein requiring proper orientation to the barrel 18 to align the orifice with the spray guard wings 20 and 22. Tip 16 preferably has a generally cylindrical base 24 and a hemispherical or domed top portion 26. Base 24 also has a groove or indentation 28 aligned with the cylindrical axis 30 of the base portion 24. A resilient washer-like seal 32 (preferably formed of Delrin plastic, available from DuPont) is located behind the base portion 24 of tip 16 A hollow set screw 34 is threaded into bore 17 to retain tip 16, and seal 32 in barrel 18. It is to be understood that set screw 34 preferably has a hexagonal bore 36 therethrough to receive an Allen wrench (not shown) for installation and removal of the set screw 34 from barrel 18.

Figure 3:
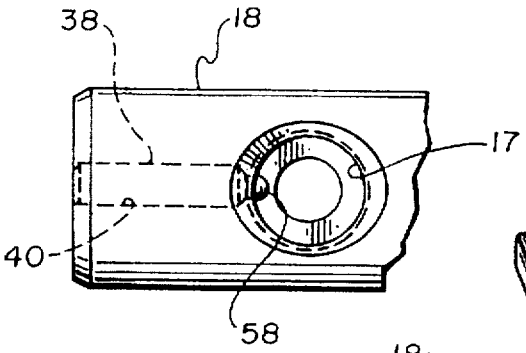
FIG. 3 is a detail view of a portion of the turret of FIG. 2.

Referring now also to FIG. 3, barrel 18 preferably has a locator pin 38 received therein in a bore 40 aligned parallel to a cylindrical axis of barrel 18. Pin 38 preferably has an interference fit with bore 40 and is pressed into bore 40, resulting in a permanent installation.

Figure 4:
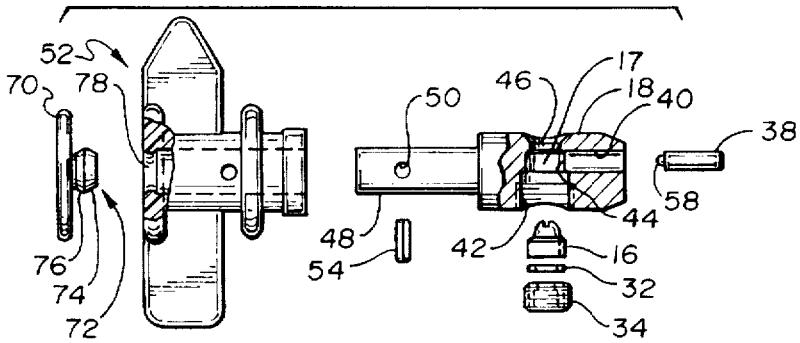
FIG. 4 is a fully exploded view of the turret and associated parts useful in the practice of the present invention.
Figure 5:
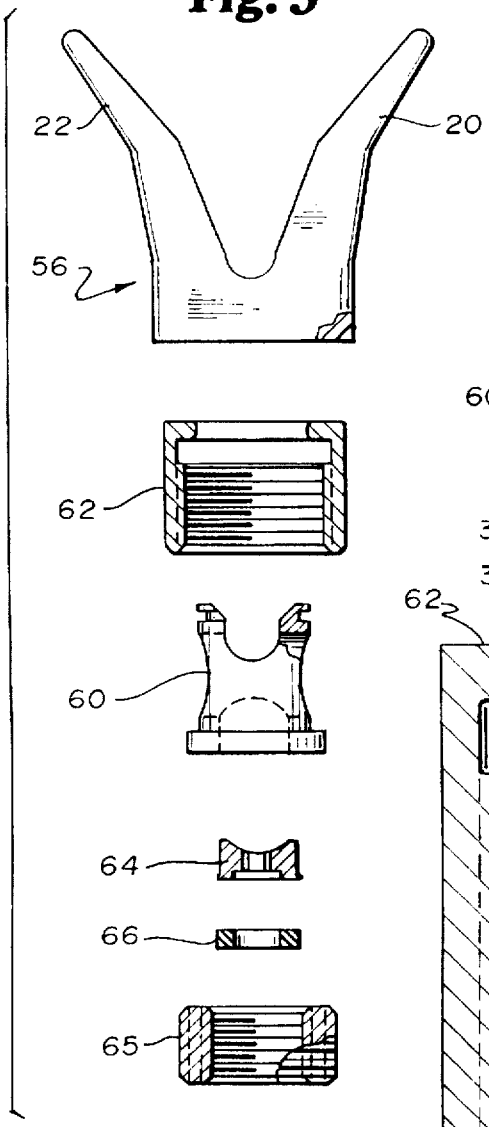
FIG. 5 is an exploded view of the reversible tip assembly useful in the practice of the present invention.
Figure 6:
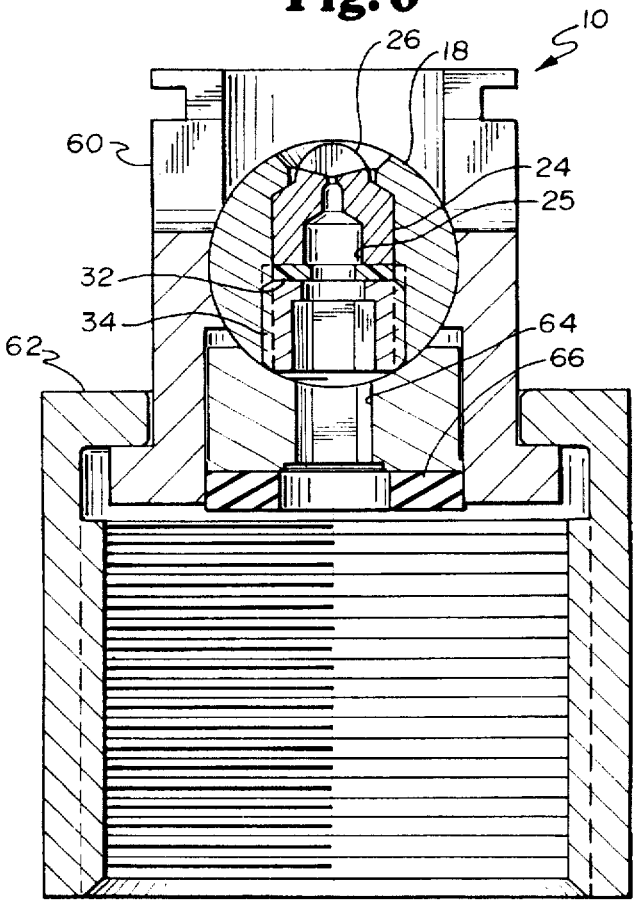
FIG. 6 is an assembly view in section of the reversible tip (without the tip guard) taken along line 6—6 of FIG. 1.
Figure 7:
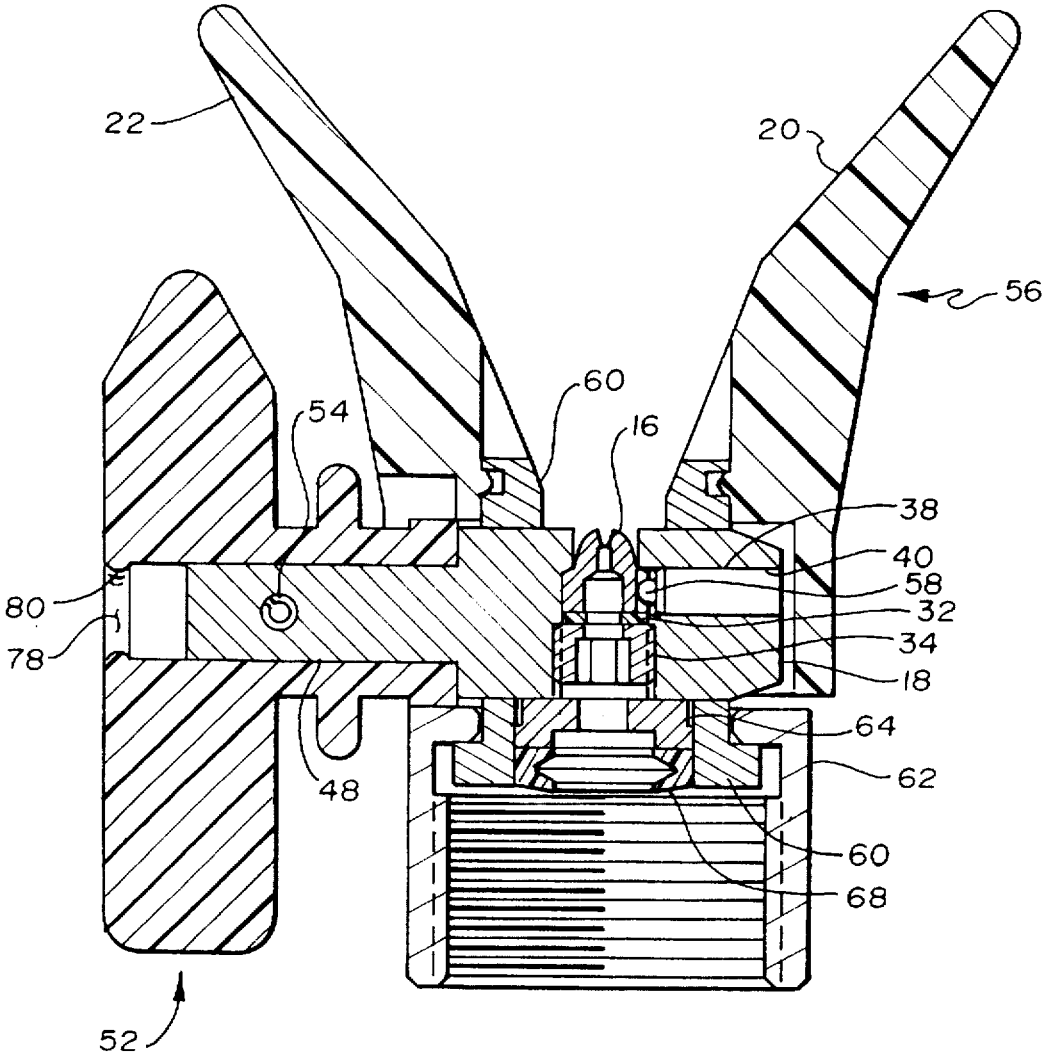
FIG. 7 is a section view of the reversible tip assembly useful in the practice of the present invention with a lip-type seal installed.
Figure 8:
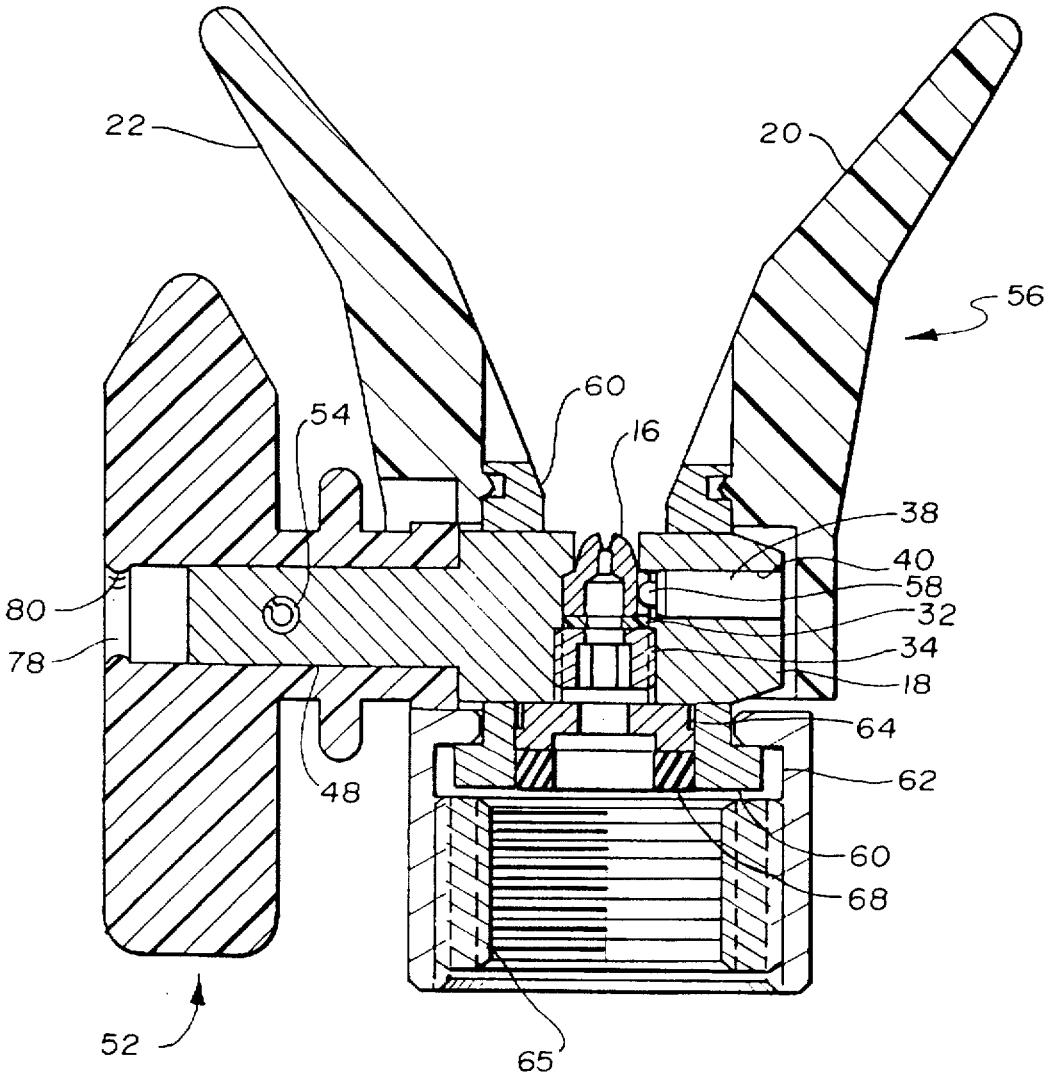
FIG. 8 is a section view similar to that of FIG. 7, except with a washer-type seal and a thread reducer installed.
Figure 9:
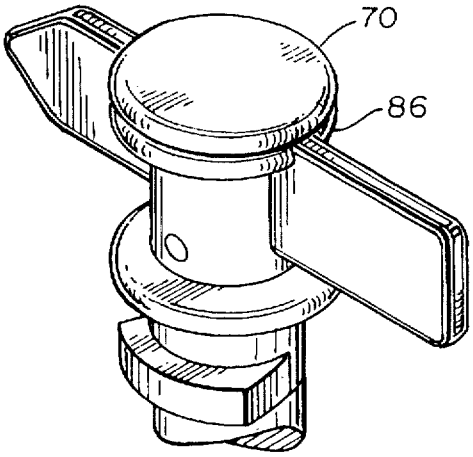
FIG. 9 is a fragmentary perspective view of the turret handle with a replaceable plug indicator installed.
Figure 10:
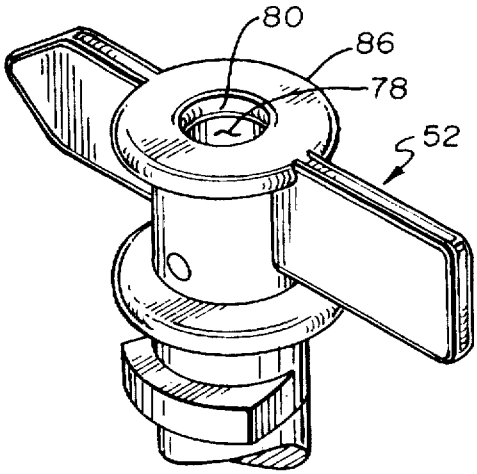
FIG. 10 is a fragmentary perspective view of the turret handle with the replaceable plug indicator omitted.
Figure 11:
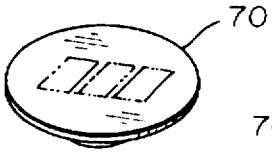
FIG. 11 is a perspective view from above of the replaceable plug indicator useful in the practice of the present invention.
Figure 12:
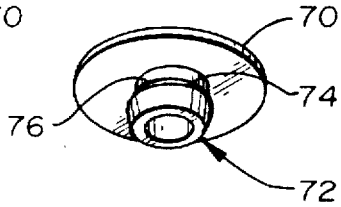
FIG. 12 is a perspective view from below of the replaceable plug indicator useful in the practice of the present invention.

Referring now also to FIG. 4, the bore 17 of barrel 18 is threaded in region 42, and preferably has a smooth-walled section 44 ending in a shoulder 46. Barrel 18 also preferably has a reduced diameter stem 48 having a transverse bore 50 therethrough to mount handle 52 using a roll pin 54. Barrel 18 and set screw 34 are preferably formed of stainless steel and pin 38 is preferably formed of stainless steel. Handle 52 is preferably formed of Delrin plastic.

Referring now also to FIGS. 5–8, the reversible tip assembly 10 also includes a molded polypropylene guard 56 having perforated ears or wings 20, 22 (see also FIG. 1), a seal retainer or mounting frame 60 preferably formed of stainless steel, and an aluminum nut 62, which may have a fluted, knurled or hexagonal exterior to secure the reversible tip assembly 10 to the gun 12. Assembly 10 also has a turret saddle seal 64 preferably of stainless steel, and either a rubber washer-like seal 66 or a lip-type Delrin plastic seal 68 (see FIG. 7). It is to be understood that rubber is preferred especially for latex paint spraying applications where water is used for clean-up, and the Delrin plastic seal is preferred for oil-based paint applications, where relatively active solvents such as MEK or lacquer thinner may be used and which would attack a rubber seal. Whether rubber or synthetic plastic material is used for the saddle seal, it has been found preferable to make the seal thickness sufficient to cause the saddle 64 to seal against the turret barrel 18 when compressed. Most desirably, the nut 62 is tightened until the saddle seal 64 is in metal-to-metal contact with the front surface of the gun 12, causing a predetermined amount of compression of seal 66 or 68 such that turret assembly 14 may be rotated between spraying and cleaning positions without loosening nut 62, while at the same time providing sufficient sealing to prevent leakage between turret barrel 18 and saddle seal 64. Also shown in FIG. 8 (and in FIG. 4) is a thread reducer 65 which may be used to match (i.e., "step down") the threads of nut 62 with reduced diameter threads on the outlet of certain spray guns.

Referring now most particularly to FIGS. 4 and 9–12, certain further details of another aspect of the present invention may be seen. A replaceable plug 70 is preferably used to carry indicia representing the operating parameters of the replaceable tip 16. When a user installs a new tip, the operating parameters may be indicated by also installing a correspondingly marked plug 70. As may be seen most clearly in FIG. 11, plug 70 may carry a three digit number in which, conventionally, the first digit represents ½ the fan width (in inches) of the spray pattern (as measured one foot from the orifice) and the second and third numbers represent the equivalent diameter (in thousandths of an inch) of a circular orifice (i.e., a circular orifice having the same cross-sectional area). For example, "817" indicates a fan width of 16" and an orifice cross-section equivalent to a 0.017" diameter circular orifice. Plug or cap 70 desirably has a stem 72 with an enlarged portion 74 and a reduced diameter portion 76. Stem 72 is sized to be removably received in a mating recess 78 in handle 52. Recess 78 has a radially inwardly directed projection 80 which may be continuous as shown or circumferentially interrupted (not shown). Projection 80 is sized to permit selective manual insertion and withdrawal of stem 72 and to retain cap 70 once installed in handle 52.

Referring now most particularly to FIGS. 2 and 3, tip 16 is installed by aligning indentation 28 on tip 16 with a dome 58 formed on the end of pin 38 and which projects into bore 17. Tip 16 is then moved toward turret barrel 18 along axis 30 until tip 16 engages shoulder 46 in barrel 18. Seal 32 is then inserted behind the base 24 of tip 16 in bore 17. Finally set screw 34 is threaded into the matingly threaded portion 42 of bore 17 in barrel 18 until secure, using a hexagonal Allen wrench received in the hexagonally shaped bore 36 in set screw 34. It is to be understood that once the above installation procedure is completed, set screw 34 will be completely within the cylindrical outer surface of barrel 18, permitting rotation barrel 18 when the barrel 18 is installed in the seal retainer 60 and resides against saddle 64. Tip 16 is removed from turret assembly 14 by unthreading set screw 34 using an Allen wrench, and withdrawing seal 32 and tip 16 axially away from barrel 18 along axis 30. When a new tip is installed, a corresponding plug 70 is preferably also installed to identify the orifice characteristics of the tip 16 then installed in turret assembly 14.

Figure 14:
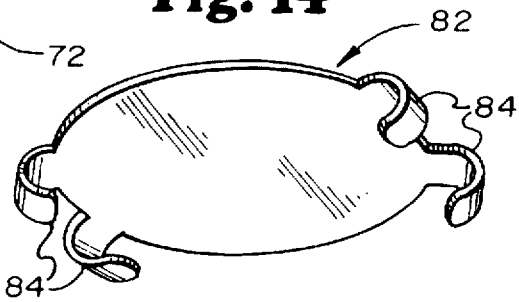
FIG. 14 is a a perspective view from below of the indicator of FIG. 13.
Figure 13:
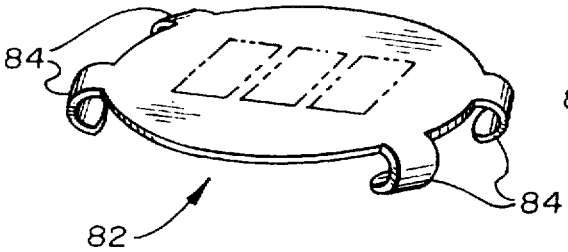
FIG. 13 is a perspective view from above of an alternative embodiment of an orifice size indicator useful in the practice of the present invention.

Referring now more particularly to FIGS. 13 and 14, an alternative embodiment of a replaceable element carrying visually perceptible indicia of orifice characteristics may be seen. In this embodiment, the element 82 is formed of metal and has curved fingers 84 sized to retain element or clip 82 to a boss 86 on handle 52.

Figure 15:
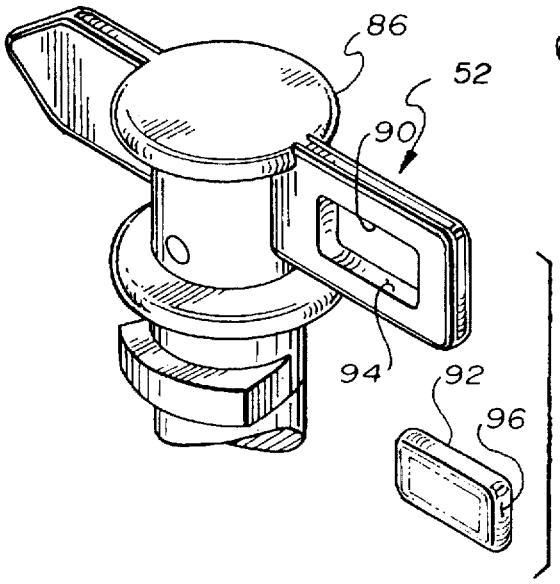
FIG. 15 is a perspective exploded view of another alternative embodiment of an orifice size indicator useful in the practice of the present invention.

Referring now most particularly to FIG. 15, an alternative embodiment of the orifice size indicator may be seen. In this embodiment, handle 52 has an aperture 90 sized to receive one or more tablets 92 carrying visually perceptible indicia of the orifice size of the tip installed. Aperture 90 is shown with a concave surface 94 and tablet 92 is shown with a mating convex surface 96, although it is to be understood to be within the scope of this invention to exchange the concavity/convexity between the tablet and handle aperture, and still further to provide other forms of interlocking shapes, provided that the size-indicating tablet is replaceable by an operator. In the embodiment shown in FIG. 15, an operator may remove an undesired tablet and insert a desired tablet (i.e., one that indicates the operating characteristics of the tip installed) by pressing the old tablet out of the aperture 90 and then elastically deforming the portion of handle 52 surrounding aperture 90 sufficiently to allow installation of a new tablet 92, preferably by manually pressing the new tablet 92 against the aperture 90 until tablet 92 is seated therein.

Figure 16:
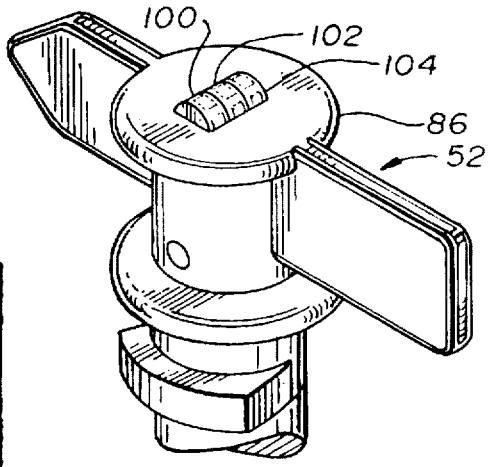
FIG. 16 is a perspective view of another alternative embodiment of an orifice size indicator useful in the practice of the present invention.

A still further alternative embodiment may be seen in FIG. 16. In this embodiment, three numbered thumbwheels 100, 102, 104 are mounted for rotation in handle 52, preferably with a detent interference with handle 52 to hold the setting of the thumbwheels. In practice, each thumbwheel is adjusted to indicate the desired parameter of the tip installed, with the first or left-most thumbwheel set to indicate one-half fan width, and the center and right-most thumbwheels set to indicate the equivalent orifice diameter in thousandths of an inch, e.g., with the setting shown of "417" indicating an 8" fan width and 0.017" diameter equivalent orifice opening.

Figure 17:
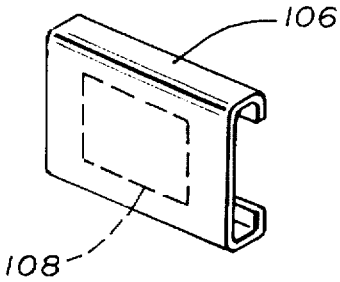
FIG. 17 is a perspective view of another alternative embodiment of an orifice size indicator useful in the practice of the present invention.
Figure 18:
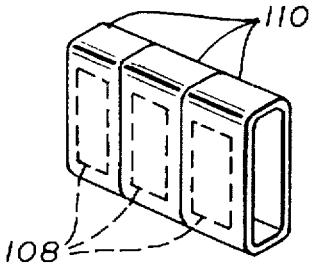
FIG. 18 is a perspective view of another alternative embodiment of an orifice size indicator useful in the practice of the present invention.

Referring now also to FIGS. 17 and 18, still further alternative embodiments of the orifice size indicator may be seen. In FIG. 17, a clip 106 is sized to be received on the leading or trailing wing of handle 52. A field 108 is provided which, in practice, will carry the three digit tip indicia mentioned above. Alternatively, one or more bands 110, which may be relatively rigid or relatively flexible, are sized to be snugly but easily received on one of the wings of handle 52. Using one digit per band may reduce the number of inventory items, but will require manipulation of more parts by the user. Bands 110 may be formed of any appropriate material such as metal or plastic or rubber.

Figure 19:
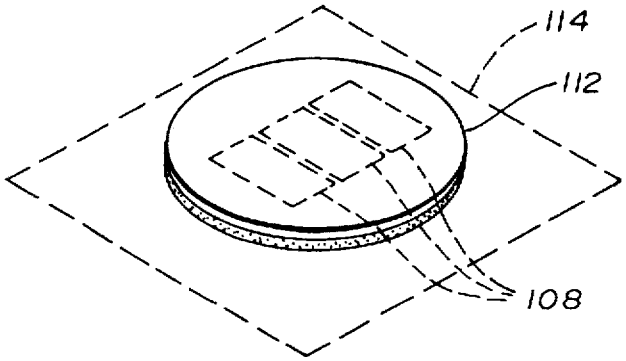
FIG. 19 is a perspective view of another alternative embodiment of an orifice size indicator useful in the practice of the present invention.

Referring now to FIG. 19, it is to be within the scope of the present invention to provide an adhesive-backed sticker 112 on a release sheet 114. When it is desired to use sticker 112, which is preferably relatively thin and flexible, it is peeled away from backing sheet 114 on which there is a release coating, such that adhesive layer 116 remains on sticker 112, allowing adhesion to the handle 52 as desired. Sticker 112 also preferably has three fields 108 and carries the visually perceptible indicia of orifice operating characteristics. Sticker 112 may be formed of any suitable material, for example, a thin layer of mylar plastic with a uniform layer of conventional contact adhesive.

Figure 20:
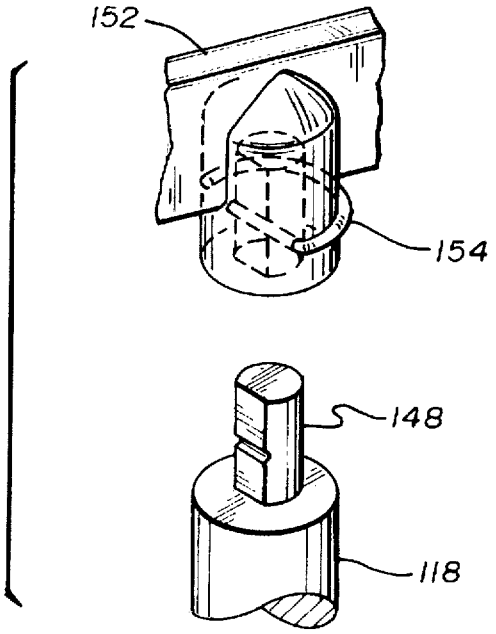
FIG. 20 is a fragmentary perspective view of an alternative structure to removably secure a handle to a stem of the turret useful in the practice of the present invention.

Referring now most particularly to FIG. 20, in this embodiment, the entire handle 152 may be replaced by drawing it manually off stem 148. In this embodiment, a new handle 152 carrying the visually perceptible indicia, for example, by printing or embossing the indicia on or in the handle 152, may have a spring 154 which will engage recess 158 when handle 152 is installed on stem 148. In this embodiment, it is to be understood that stem 148 is attached to a barrel 118 containing the tip of the alternative embodiment.

Figure 21:
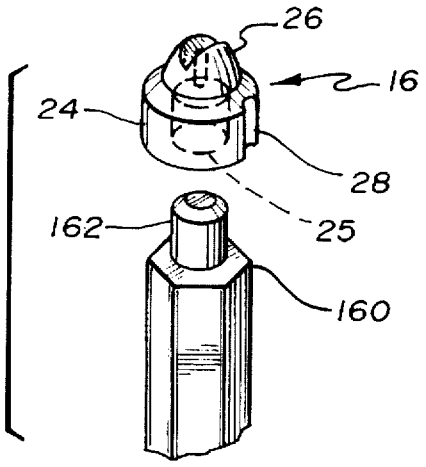
FIG. 21 is a fragmentary perspective view of a replaceable tip element and an installation tool useful in the practice of the present invention.

Referring now most particularly to FIG. 21, a perspective view of the replaceable tip element 16 may be seen with an installation tool 160. Tool 160 is preferably an Allen wrench with one end having a reduced diameter portion 162 which mates with a bore 25 in base 24 of tip 16 (see also FIGS. 2 and 6). To install tip 16 in bore 17, tip 16 is preferably placed on the reduced diameter portion 162 of Allen wrench 160 and the keyway 28 is aligned with the projection 58 to allow the tip 16 to move axially into contact with shoulder 46. Seal 32 is then installed behind tip 16 and hollow set screw 34 is threaded into the threaded portion 42 of bore 17, preferably using the Allen wrench to compress seal 32 against tip 16 to prevent leakage around the outer surface of tip element 16. To remove tip 16, the process is reversed, first unthreading set screw 34 using Allen wrench 160, then removing seal 32 and tip 16. The reduced diameter portion 162 of wrench 160 is typically not needed for removal of tip 16.

The invention is not to be taken as limited to all of the details thereof as modifications and variations thereof may be made without departing from the spirit or scope of the invention.

What is claimed is:

1. A reversible tip assembly comprising;

a) a rotatable, generally cylindrical turret having a transverse bore therethrough and a handle at one longitudinal end thereof;

b) a replaceable tip element having a spray orifice therein removably secured in the transverse bore of the turret by a hollow set screw; and c) a mounting frame having a transverse bore therethrough for rotatably securing the turret to a paint spray gun and having a longitudinal bore therethrough and intersecting the transverse bore of the frame for permitting the passage of paint therethrough, with the transverse bore of the turret alignable with the longitudinal bore of the frame; and wherein the transverse bore of the turret and the tip element have mating non-circular cross sections taken transverse to the transverse bore of the turret to align the orifice in the replaceable tip element in a repeatable relationship to the turret.

2. The assembly of claim 1 wherein the non-circular cross-section of the bore of the turret further comprises a projection extending into the transverse bore of the turret.

3. The assembly of claim 2 wherein the projection comprises a drive pin pressed into a longitudinal bore in the turret intersecting the transverse bore of the turret.

4. The assembly of claim 1 wherein the tip element has a generally circular periphery interrupted by an indentation.

5. The assembly of claim 4 wherein the indentation of the tip element is congruent with a projection formed by a drive pin and extending into the transverse bore of the turret.

6. The assembly of claim 1 further comprising:

d) a resilient seal received in the transverse bore of the turret between the replaceable tip and the hollow set screw.

7. A method of installing a replaceable tip element in a rotatable turret assembly comprising the steps of:

a) aligning mating non-circular cross-sections of a replaceable tip element and a transverse bore in a barrel of a rotatable turret assembly;

b) moving the replaceable tip element axially into the transverse bore of the turret until the tip contacts a radially inwardly directed shoulder in the transverse bore of the turret; and c) threading a hollow set screw into the bore to retain the tip in the turret.

8. The method of claim 7 further comprising the additional step between steps b) and c) of b1) inserting a resilient seal into the bore after inserting the tip element such that the seal is compressed when the hollow set screw is threaded into the bore to prevent leakage around the outside of the tip element.

* * * * *